US007041922B2

(12) United States Patent
Geiger et al.

(10) Patent No.: US 7,041,922 B2
(45) Date of Patent: May 9, 2006

(54) KEY ARRANGEMENT FOR A CONTROL PANEL

(75) Inventors: Peter Geiger, Eningen u.A. (DE); Ronald Hegewald, Laaber (DE); Michael Seikel, Berlin (DE)

(73) Assignee: Prettl Appliance Systems GmbH, (DE)

( * ) Notice: Subject to any disclaimer, the term of this patent is extended or adjusted under 35 U.S.C. 154(b) by 0 days.

(21) Appl. No.: 10/944,431

(22) Filed: Sep. 16, 2004

(65) Prior Publication Data

US 2005/0109592 A1 May 26, 2005

(30) Foreign Application Priority Data

Sep. 17, 2003 (DE) ..... 103 44 917
Jan. 21, 2004 (DE) ..... 10 2004 004 247

(51) Int. Cl.
*H01H 13/04* (2006.01)
*H01H 13/08* (2006.01)

(52) U.S. Cl. ..... 200/296; 200/293; 200/314

(58) Field of Classification Search ..... 200/293, 200/334, 314, 341, 520, 296, 330, 343–345
See application file for complete search history.

(56) References Cited

U.S. PATENT DOCUMENTS 4,978,817 A * 12/1990 Honda ..... 200/50.1
5,045,656 A * 9/1991 Kojima ..... 200/314

* cited by examiner

*Primary Examiner*—K. Lee
(74) *Attorney, Agent, or Firm*—Anthony B. Diepenbrock, III; Dechert LLP

(57) ABSTRACT

The invention proposes a key arrangement for a control panel, particularly for domestic machines such as washing machines, driers etc., having at least one key with a front control face and at least one backward-protruding projection, a key support which has at least one opening through which the projection passes, and elastic means which are borne on the back of the key support, the elastic means engaging with the projection which passes through the opening and prestressing the key forwards from the key support.

19 Claims, 7 Drawing Sheets

KEY ARRANGEMENT FOR A CONTROL PANEL

BACKGROUND OF THE INVENTION

The present invention relates to a key arrangement for a control panel, particularly for domestic machines such as washing machines, driers etc.

The present invention also relates to a panel arrangement having such a key arrangement.

Domestic machines such as washing machine and driers are made only by a few manufacturers and only in a few basic variants today. However, these machines are marketed in a wide variety of variants and under various brand names. The brands and variants are distinguished from one another by the control panel, inter alia. Although the control panels are outwardly different in terms of design and functionality, they are often also based on similar basic elements, such as switches, keys etc. Only the switch and key panels located on the outside of the control panel are in turn different in terms of design.

Almost all domestic machines of this kind have keys on their control panel for triggering particular functions. In this case, the keys are normally elastically prestressed counter to their direction of operation and are designed to operate microswitches which are fixed behind the control panel. Some keys have a transparent portion (light guide). The light guide then normally has an associated lighting means, e.g. an LED, behind the control panel. The light guide allows the state of the respective function to be displayed.

The keys are often not operated exactly centrally. Operation at the periphery of the key may result in tilting or even jamming. This can be avoided only with difficulty.

It is also necessary to be able to connect the most widely differing key designs as far as possible to a standard switching and display technology behind the control panel.

Finally, the problem of watertightness is also not insignificant. In the area surrounding domestic machines such as washing machines and driers, liquids such as detergent or water are often handled without care. The entry of such liquids in the region of the keys must not impair operation.

SUMMARY OF THE INVENTION

Against this overall background, it is the object of the present invention to specify an improved key arrangement for a control panel and a control panel having such a key arrangement.

This object is achieved by a key arrangement for a control panel, particularly for domestic machines such as washing machines, driers etc., having

- at least one key with a front control face and at least one backward-protruding projection,
- a key support which has at least one opening through which the projection passes, and
- elastic means which are arranged on the back of the key support, the elastic means engaging with the projection which passes through the opening and prestressing the key forwards from the key support.

The concept of providing a separate key support allows the associated switch and display technology to be arranged on the key support. Such a key support may be provided for a single key. Normally, however, a key support is provided for a plurality of keys.

The elastic means borne on the back of the key support generally prestress the key forwards from the key support into a basic position. This means that it is not necessary to provide such elastic means on the control panel.

The above object is also achieved by a panel arrangement for a domestic machine which has a control panel and a key arrangement based on the invention.

The object is therefore achieved in full.

It is particularly advantageous if the key support is in plate form. This means that the key support is easy to make, for example from a plastic material.

In line with a further embodiment, the key support has a plurality of openings for bearing a plurality of keys.

In this context, it is particularly advantageous if the openings are at regular intervals.

This firstly allows the keys to be arranged in a regular pattern. Secondly, the regular interval can be used to arrange keys of different dimensions on the key support.

It is thus particularly advantageous if the keys have different dimensions and if the dimensions of the keys and the position of the projections on the keys are coordinated with one another such that the positioning of the keys on the key support is variable.

In other words, the positioning of the openings and of the projections and also the dimensions of the keys are used to set up an assembly of prefabricated machine parts. This makes it possible to fit different combinations of keys to a key support.

In line with a further preferred embodiment, the back of the key support has a printed circuit board arranged on it with at least one switch which can be operated using the key.

The combination of key support and printed circuit board allows the whole switch and display technology to be of modular and yet compact design. In this case, the printed circuit board may have different components fitted, for example depending on functionality.

It is particularly advantageous in the case of this embodiment if the switch is arranged on the back of the printed circuit board and if the projection on the key operates a lever which operates the switch.

The arrangement of the switch on the back of the printed circuit board allows the printed circuit board to be assembled close to the key support.

The lever allows the switch located on the back to be operated. In this case, the direction in which the switch is operated is normally opposite to that in which the key is operated.

It is also advantageous if the lever is borne on the key support.

This reduces the total number of parts.

In line with a further preferred embodiment, the back of the key support has latching projections on it onto which the printed circuit board is latched.

This results in a simple, uncomplicated connection between key support and printed circuit board.

The latching projections may also be designed for bearing the levers.

It also advantageous if the key support has a row of openings on it and if the printed circuit board is arranged offset from the row of openings, in a direction parallel to the plane of the key support.

This allows the keys' projections which pass through the openings to pass by the printed circuit. This simplifies the overall design, particularly when switches are arranged on the back of the printed circuit board.

In line with a further particularly preferred embodiment, the key support is made of a transparent material, for example a transparent plastic.

This allows lighting means such as LEDs to be provided on the printed circuit board. The light from these then passes through the key support onto the back of the key and hence onto the latter's inserted light guide.

It is thus particularly advantageous if the front of the printed circuit board has at least one visual display or lighting means, particularly an LED, arranged on it.

It is also advantageous if the elastic means are in the form of a backward-protruding shroud made of an elastic material, into which the projection engages.

This allows the restoring force when the key is operated to engage directly on the projection. This permits safe, jam-free restoring, even if the key is not operated centrally.

It is particularly advantageous if the shroud is closed.

This allows the outside with the key to be sealed from the inside with the switch and display technology.

It is particularly advantageous if the shroud is made of an elastic plastic and if the key support is made of a more rigid plastic material.

As a result of this, the key support forms a kind of "anchor" for the elastic shroud.

In this case, it is particularly advantageous if the key support and the shroud are cohesively connected to one another.

This allows the key support and the shroud or the plurality of shrouds to be made as one part. In addition, it is even easier to seal the outside from the inside.

In this context, it is of great advantage if the key support and the elastic means are made using a two-component injection moulding method.

With this kind of injection moulding method, the key support and the shroud can be made as one part even though they are made of different plastics.

It is of great advantage for the inventive panel arrangement if a key support in the key arrangement is cohesively connected to the back of the control panel.

This makes it a simple matter to mount the key support on the control panel. As a result, the key and the switch and display technology are indirectly borne on the control panel.

It is particularly advantageous if a peripheral portion of the key support is welded linearly to the back of the control panel.

This results in a compact design. A linear weld is easy to make.

In this context, it is particularly advantageous if the periphery of the key support is welded linearly to the back of the control panel around the full circumference.

In the case of this embodiment, the "outside" is fully sealed from the "inside" of the domestic machine.

It goes without saying that the features which are cited above and those which are yet to be explained below may be used not only in the respectively indicated combination, but also in other combinations or on their own, without departing from the scope of the present invention.

BRIEF DESCRIPTION OF THE DRAWINGS

Exemplary embodiments of the invention are shown in the drawing and are explained in more detail in the description below. In the drawing.

DETAILED DESCRIPTION OF PREFERRED EMBODIMENTS OF THE INVENTION

Figure 1:
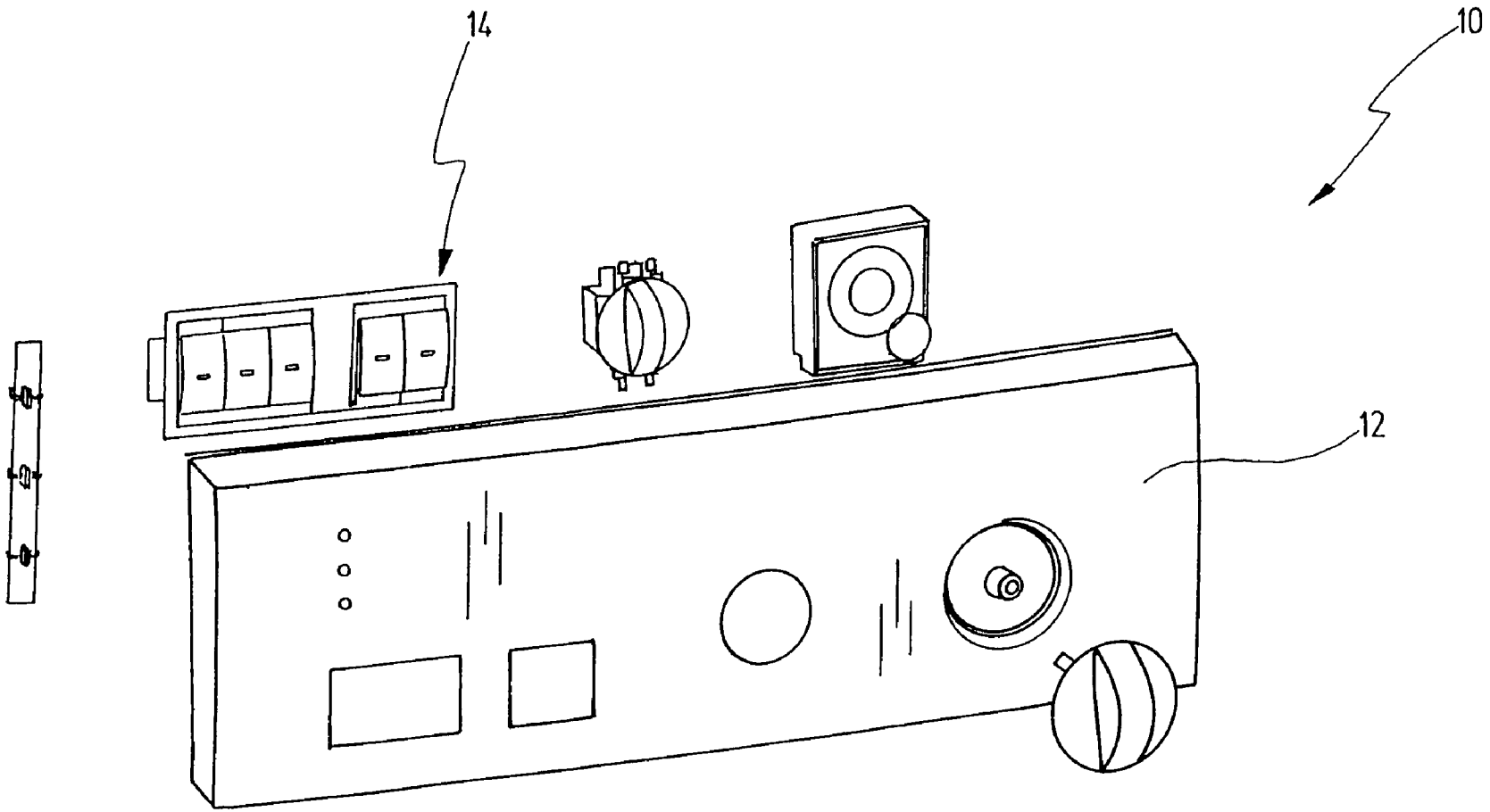
FIG. 1 shows an exploded view of a panel arrangement for a domestic machine in line with one embodiment of the invention.

In FIG. 1, an embodiment of the inventive panel arrangement is denoted generally by 10. The panel arrangement 10 is provided for a domestic machine such as a washing machine or a tumble drier and contains the control and display elements for controlling the domestic machine and for displaying its respective state.

The panel arrangement 10 has a panel 12 which is in the form of a plastic plate with a circumferential periphery. The front of the panel 12, which is shown in FIG. 1, is provided with a high-quality surface, in order to impart a high value to the domestic machine.

On the right-hand side of the panel there are two rotary switches. One of the rotary switches is designed, by way of example, to preselect a programme for the washing machine or tumble drier. Another rotary switch may be designed, by way of example, to preselect a particular spin speed or a particular temperature.

The panel 12 also has a display (not denoted in more detail). For this purpose, a strip containing lighting means (such as LEDs) is borne on the back of the panel 12.

The panel arrangement 10 also contains a key arrangement, which is denoted generally by 14 in FIG. 1.

The key arrangement 14 contains five keys which are split into two groups. One group contains three keys and the other group contains two keys. The two groups are at a physical distance from one another. Accordingly, the panel 12 contains two cutouts of different size for the key groups.

Figure 2:
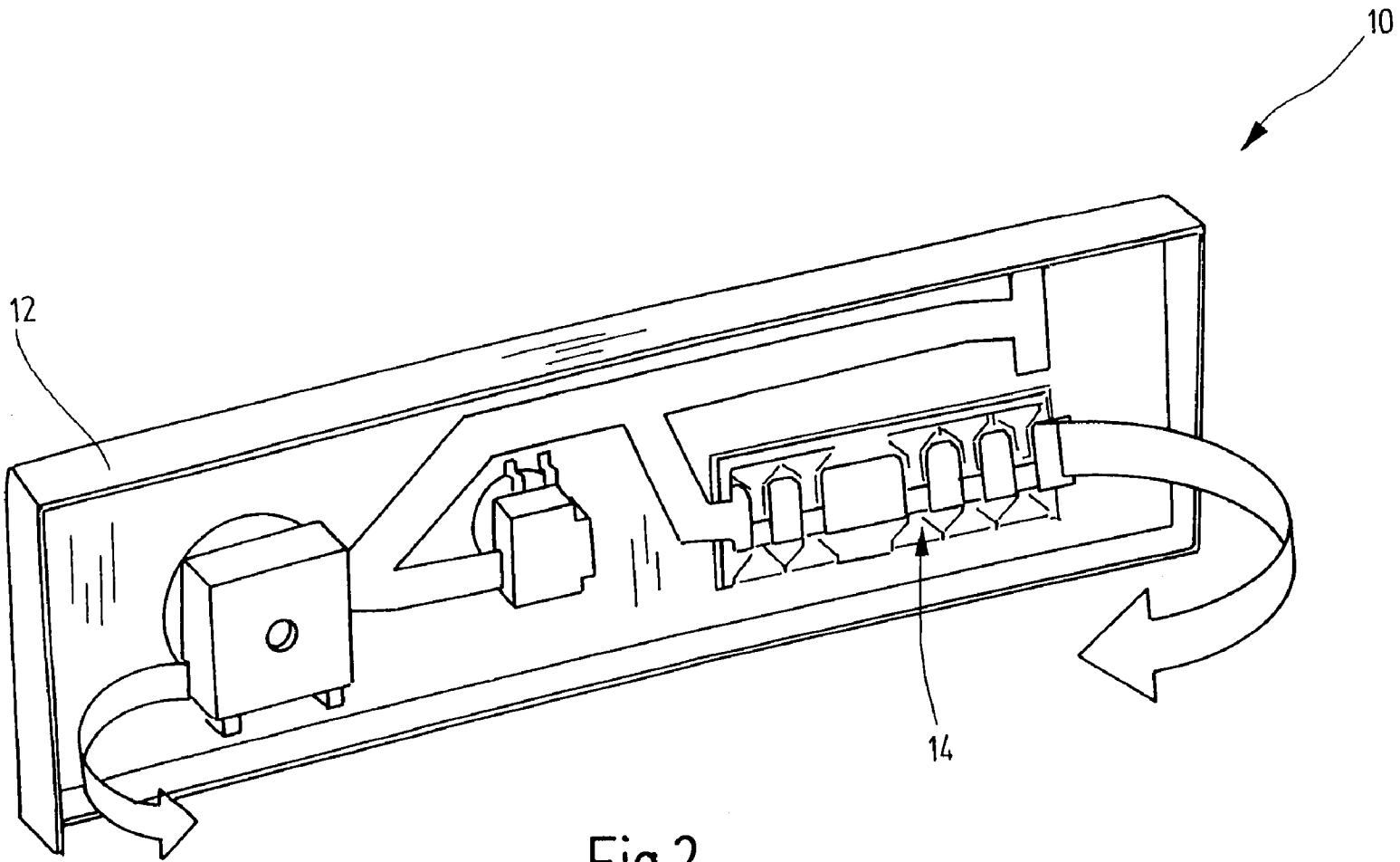
FIG. 2 shows the panel arrangement from FIG. 1 in a view from the back.

FIG. 2 shows the panel arrangement 10 in an assembled state from the back.

On the left-hand side it is possible to see the two rotary switches. On the right-hand side the key arrangement 14 is fitted on the back of the panel 12. FIG. 2 also shows that the different control and display elements on the panel arrangement 10 are connected by means of wiring to one another and to superordinate control electronics and a power supply.

Figure 3:
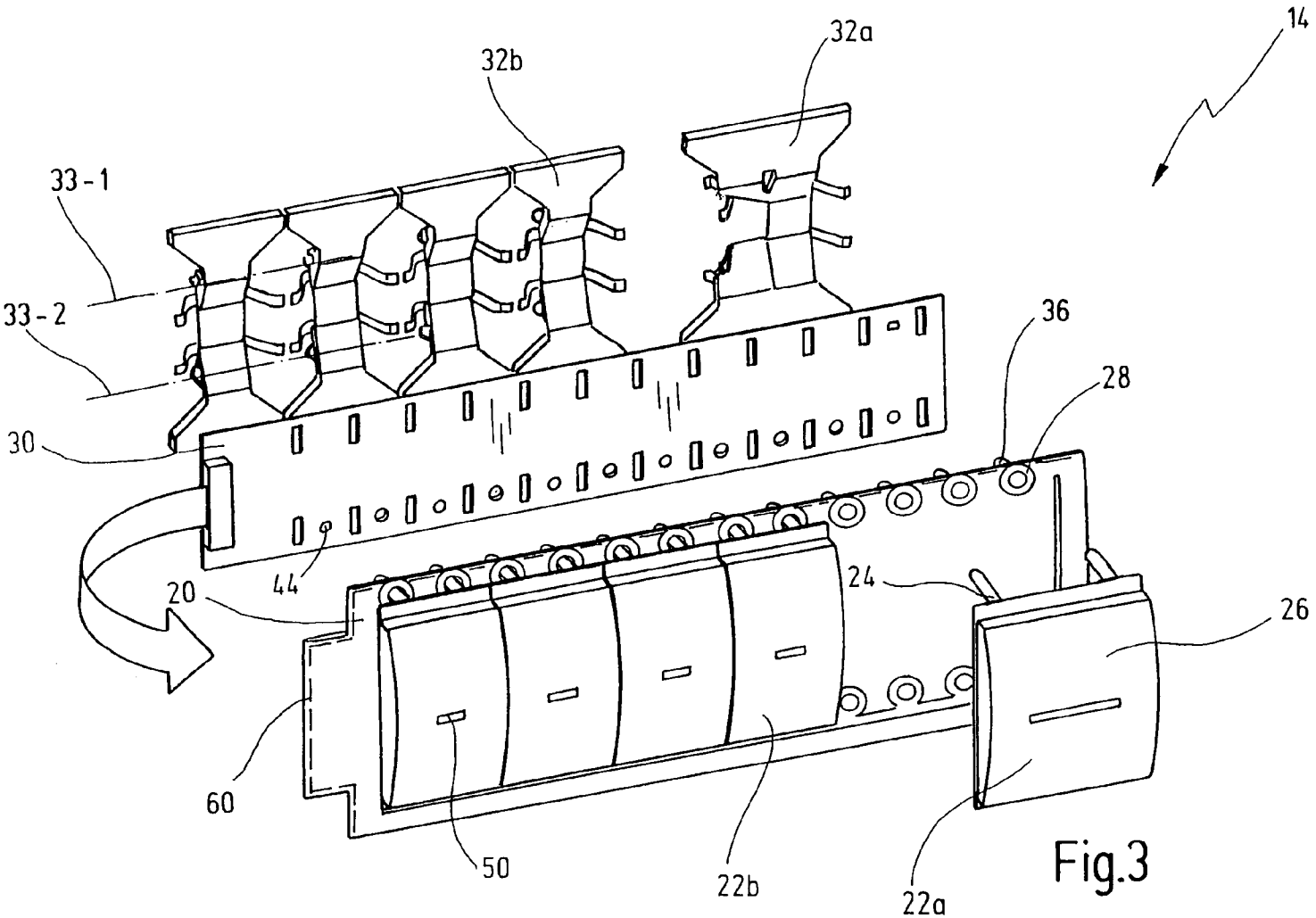
FIG. 3 shows an exploded view of a key arrangement in line with one embodiment of the invention.
Figure 4:
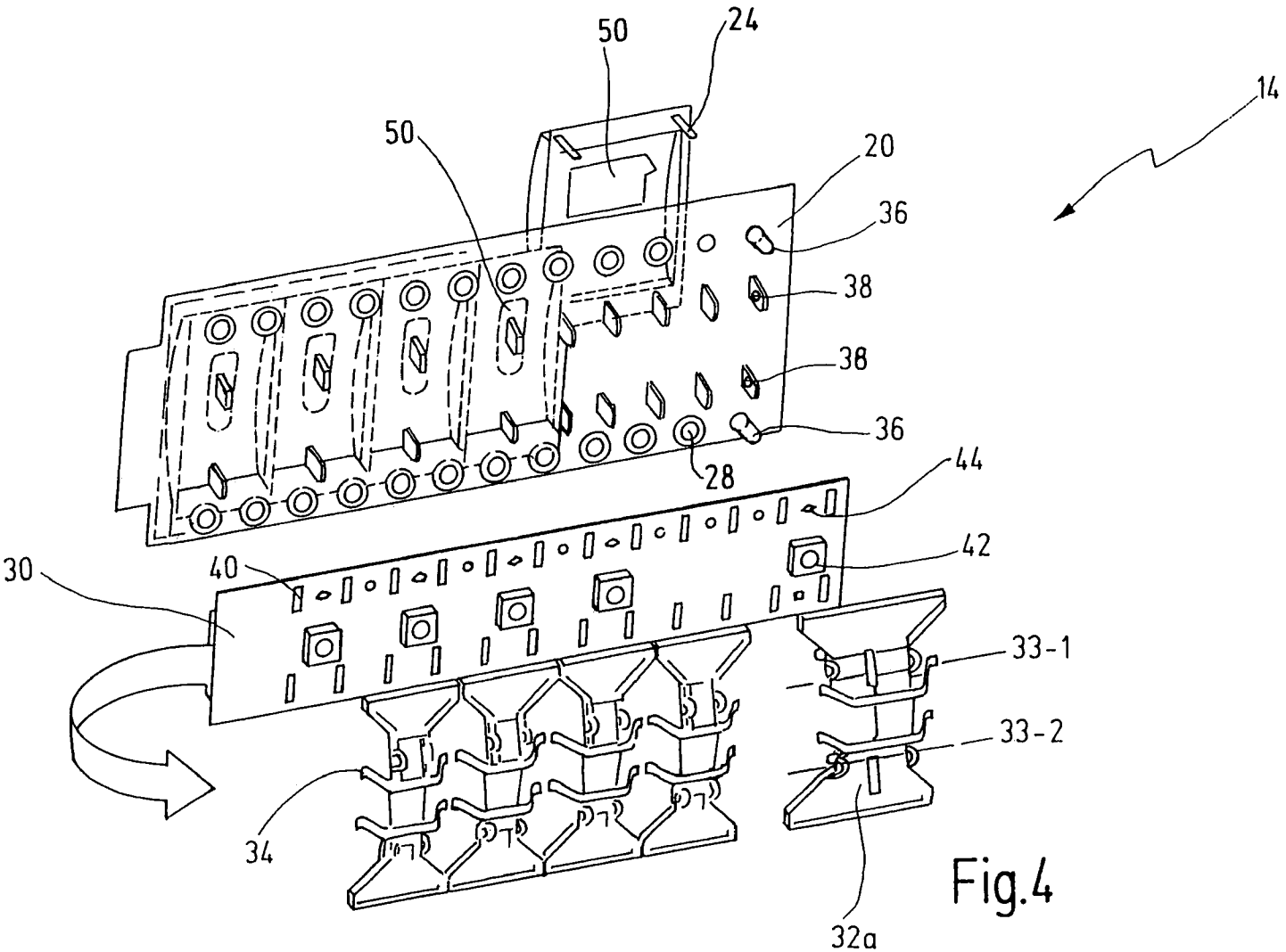
FIG. 4 shows the exploded view in FIG. 3 from the back.

In FIGS. 3 and 4, a further embodiment of a key arrangement in line with the invention is denoted generally by 14.

The key arrangement 14 has a key support 20. The key support 20 is generally in plate form and is designed for bearing a plurality of keys 22.

For this embodiment, FIGS. 3 and 4 show four narrow keys 22*b* and one wide key 22*a*, which are borne on the key support 20.

The front of the keys 22, which can be seen in FIG. 3, is provided with a control face 26. The back of each of the keys 22 has four peg-like projections 24. In the respective plan view, the keys 22 are of approximately rectangular design. The four projections 24 are provided approximately in the region of the four corners and protrude backwards.

The key support 20 contains two rows of openings 28. The key support is of generally elongate design. One row of openings 28 is provided along a top edge. The other row of openings 28 is provided along the bottom edge.

The openings 28 are at regular intervals. The interval between the openings 28 is chosen such that two top projections 24 on a narrow key 22*b* fit into two adjacent openings 28 in one row of openings. Correspondingly, two bottom projections 24 on the same key 22*b* fit into two adjacent openings 28 in the bottom row.

The interval between the projections 24 on the wider key 22*a* is chosen such that these projections fit into two openings 28 which are at twice the interval. In other words, a further (unused) opening 28 is arranged between the two openings 28.

It goes without saying that other kinds of keys might have projections 24 at even greater intervals.

The shape of the control face 26 is largely decoupled from the arrangement of the projections on the respective keys 22. In the case illustrated, the control face 26 is shaped such that it curves approximately convexly outwards in cross section. The shape of the keys could also be oval or circular, however. It goes without saying merely that the shape of the key should match corresponding cutouts in an associated panel 12. However, oval or circular keys may also have four projections 24 which fit into the openings 28 in the key support 20.

In other words, the key support 20 is of universal design. Keys used in conjunction with this key support 20 merely should have four projections 24 whose spacing matches the matrix of the openings 28 in the key support 20.

The back of the key support 20 has a printed circuit board 30 arranged on it. The printed circuit board 30 is likewise approximately rectangular and has a height such that it is arranged between the two opposite rows of openings 28. In other words, the printed circuit board 30 does not cover the openings 28 from the back.

The key arrangement 14 also has a row of key levers 32, specifically one associated key lever 32 for each key 22.

The key levers 32 are provided on the back of the printed circuit board 30. Each key lever 32 has a middle portion and two opposite lever portions. A top lever portion is connected to the middle portion via an axis of rotation 33-1. A bottom lever portion is connected to the middle portion via a further axis of rotation 33-2.

The key levers 32 are borne in the region of the back of the printed circuit board 30 such that the lever portions are situated behind the openings 28 through which projections 24 of the associated key 22 engage.

In addition, the middle portion is provided with restoring springs 34 which are supported on the back of the printed circuit board 30. This prestresses the middle portions of the key levers 32 into a basic position away from the back of the printed circuit board 30.

The back of the key support 20 has a plurality of shrouds 36 made of an elastic plastic material arranged on it. Preferably, the shrouds 36 are made using a two-component injection moulding method together with the key support 20.

The shrouds 36 are closed and form a closed receptacle ("hood") for the respective projections 24. The length of the projections 24 and the length of the shrouds 36 are coordinated with one another such that the keys 22 are prestressed generally into a basic position away from the key support 20 on account of the elasticity of the shrouds 36.

In FIG. 3, it is possible to see that the keys 22 each have an attachment (not designated in more detail) at their top and bottom ends. In the fitted state, this attachment is in contact with the back of a panel 12. This contact position determines the position of rest for the keys 22.

Integrally formed on the back of the key support 20 is a plurality of latching projections 38. Correspondingly, the printed circuit board 30 contains a plurality of slots 40. The position and size of the slots 40 correspond to those of the latching projections 38.

To assemble the key support 20 and printed circuit board 30, the printed circuit board is pushed onto the key support 20 such that the latching projections 38 enter the slots 40. The latching projections 38 have suitable latching means, so that the printed circuit board 30 is fixed on the key support 20 in latching fashion as a result.

In addition, the latching projections 38 are designed for bearing the key levers 32. More precisely, the key levers 32 have latching lugs (not designated in more detail) in order to fix the key levers 32 on the latching projections 38 which protrude from the back of the printed circuit board 30. In this case, the latching projections 38 simultaneously serve as bearing points for setting up the axes of rotation 33-1 and 33-2.

FIG. 4 does not show all of the latching projections 38, for reasons of clarity. However, it is generally preferred for the latching projections 38 to form two rows at respectively uniform intervals parallel to the openings 28.

This makes it possible for the latching projections 38 to bear both narrow key levers 32*b* and wider key levers 32*a*.

The wide key levers 32*a* have a cutout between two bearing points in order to accommodate an unused latching projection 38 without touching.

The back of the printed circuit board 30 has microswitches 42 arranged on it. The number of microswitches 42 corresponds to the number of keys 22.

The microswitches are arranged in a middle region of the printed circuit board 30, specifically between respective slots 40 which are associated with a key 22.

The direction in which the microswitches 42 are operated is opposite to the direction in which the keys 22 are operated.

Figure 5:
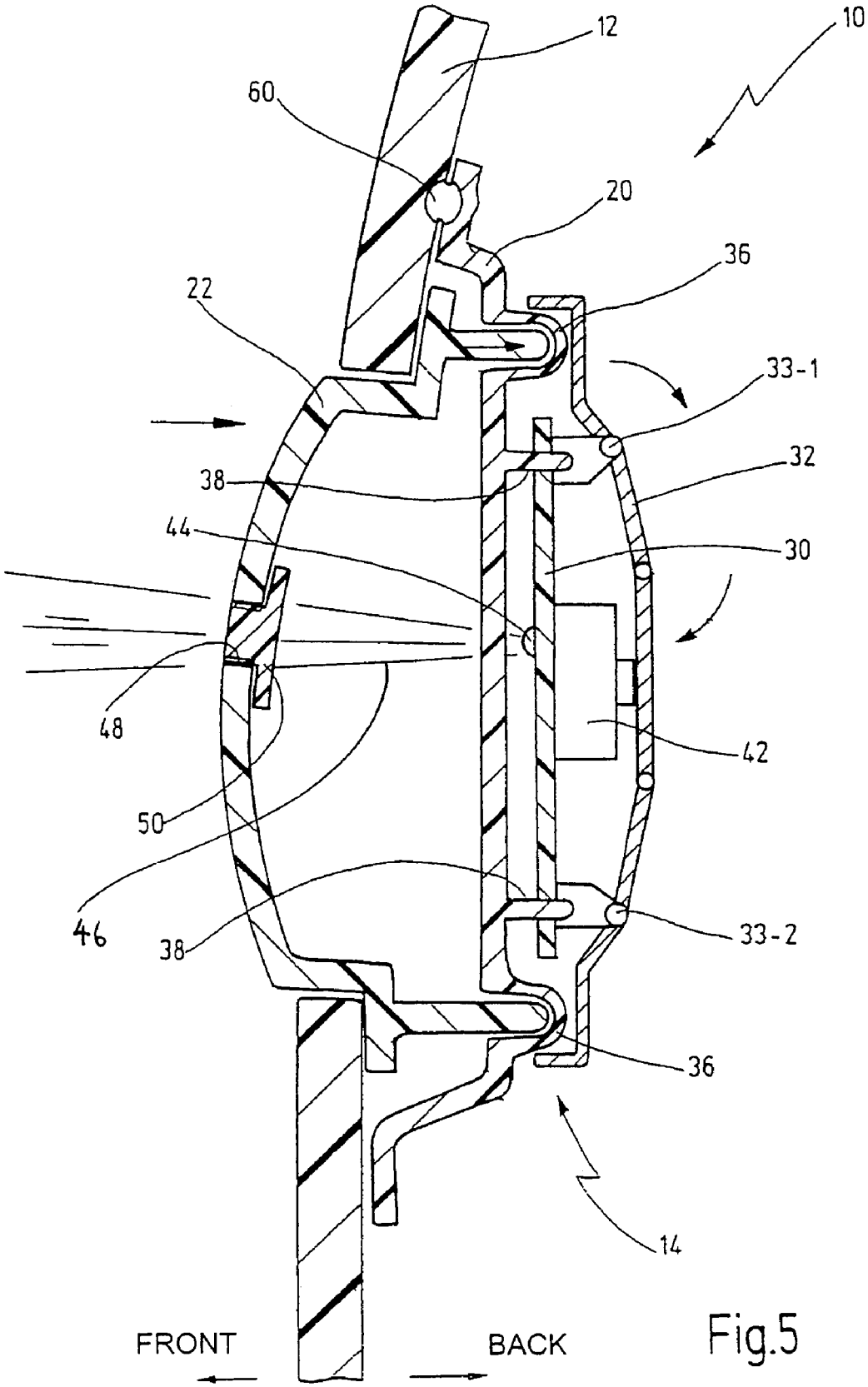
FIG. 5 shows a schematic cross-sectional view through a panel arrangement in line with a further embodiment of the invention.

FIG. 5 shows a schematic cross-sectional view through the key arrangement 14 from FIGS. 3 and 4 in a state fitted on a panel 12 in a panel arrangement 10.

The way in which this panel arrangement 10 or the associated key arrangement 14 works is explained below with reference to FIG. 5.

The key support 20 is fixed on the back of the panel 12. The key 22 shown protrudes through an opening in the panel 12. An attachment which protrudes upwards and an attachment which protrudes downwards prevent the key 22 from falling out towards the front.

To operate the microswitch 42, the key 22 can be pushed at any point. If the key 22 is pushed backwards at its top end, as indicated by an arrow, the top projection 24 pushes against the shroud 36 from inside. This pivots the lever portion of the key lever 32 backwards, as shown by a further arrow. This pushes the middle portion of the key lever 32 forwards, as shown by another arrow. This operates the microswitch 42. If the key 22 is operated centrally, the top and bottom lever portions of the key lever 32 are operated. If the bottom part of the key 22 is operated, then the microswitch 42 is operated merely via the bottom lever portion, which is pivoted about the axis of rotation 33-2.

Since the key 22 has not just two projections 24 but rather four projections, the key 22 can also be operated in the direction perpendicular to the plane of the paper in FIG. 5 at any point. The middle portion of the key lever 32 is in all cases moved safely and in a jam-free manner towards the microswitch 42, in order to operate it.

The projection or projections 24 which have been pushed backwards hit the base of the respective shroud 36 made of elastic material. The shroud or shrouds 36 are then deflected elastically backwards when the key 22 is operated.

As soon as the key 22 is no longer being touched, the key 22 is pushed back forwards, specifically on account of the elastic restoring force of the shrouds 36.

The middle portion of the key lever 32 is returned to its starting or basic position, in which it does not operate the microswitch 42, again by the restoring springs 34. In this case, the restoring springs 34 are supported on the back of the printed circuit board 30.

FIG. 5 schematically shows that the axes of rotation 33-1 and 33-2 are borne by a projection which protrudes from the back of the printed circuit board 30, said projection being different than the projection 38 on the key support 20. However, it goes without saying that the axes of rotation may also be borne directly on the latching projections 38.

The front of the printed circuit board 30 may have one or more LEDs arranged on it for display purposes. By way of example, each microswitch 42 may have an associated LED 44 which indicates its operating state.

The key support 20 is preferably made of a transparent material. The light radiated by the LED 44 thus falls on the back of the key 22. Alternatively, it is also possible for the key support 20 to have appropriate cutouts for the LED light.

The LED light falling on the back of the key 22 is shown at 46.

The key 22 has a central opening 48 into which a transparent insert 50 is clipped.

Accordingly, the LED light 46 can be seen from the front of the key 22 through the insert 50.

Alternatively, it is possible to make the entire key 22 from a transparent material.

The material of the key support 20 may be ABS, for example. The keys 22 may also be produced without a transparent insert (or light guide) 50.

FIG. 5 also shows that the key support 20 is fixed on the back of the panel 12 by means of a linear weld 60.

This cohesive connection firstly makes it possible to ensure that the key support 20 is held captively on the panel 12. Secondly, such a linear weld 60 is comparatively easy to make.

The linear weld 60 may, as FIG. 5 shows, be provided just in a top region of the key support 20. By way of example, welding spots may be provided on the underside in order to attain good fixing.

If a liquid such as liquid detergent or water enters between the key 22 and the panel 12, it cannot get to the back of the key arrangement 20. This is because the shrouds 36 are closed. The entering liquid is therefore unable to get through the openings 28 to the back of the key support 20 and hence to the printed circuit board 30.

To prevent such liquid from damming up in a cavity between the key support 20 and the key 22, at least portions of the bottom edge of the key support 20 may not be welded to the panel 12, as shown in FIG. 5. The liquid entering can therefore drain downwards on the inside of the panel 12.

Alternatively, it is also possible for the linear weld 60 to be fully circumferential in order to prevent liquid from getting behind the panel 12.

Figure 6:
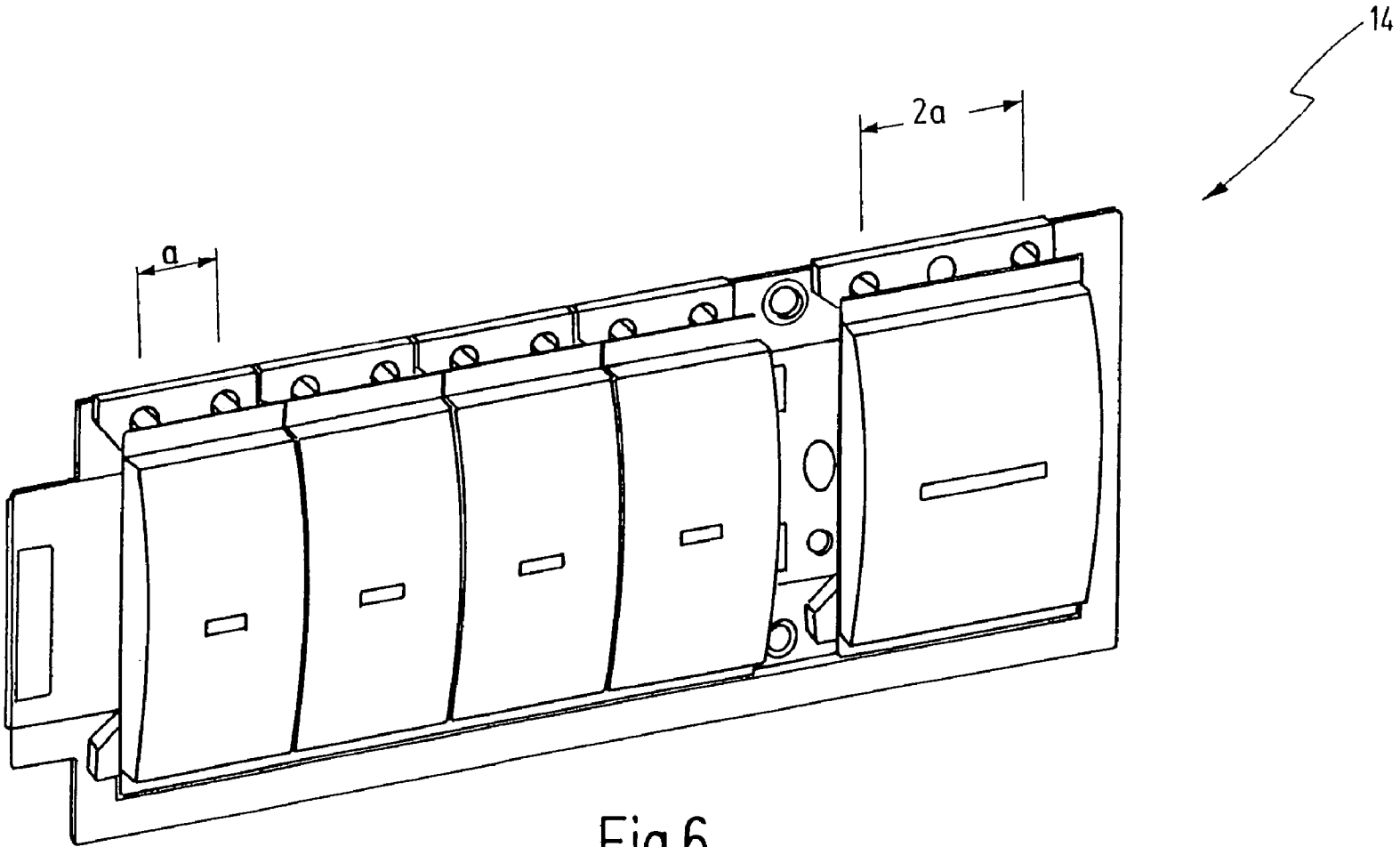
FIG. 6 shows a perspective view of a key arrangement in line with the present invention in the assembled state.

FIG. 6 shows the key arrangement 14 from FIGS. 3 and 4 in the assembled state.

It can be seen that the projections 24 on the keys 22*b* are at an interval of a. By contrast, the projections 24 on the wider key 22*a* are spaced apart by twice the value 2*a*.

Figure 7:
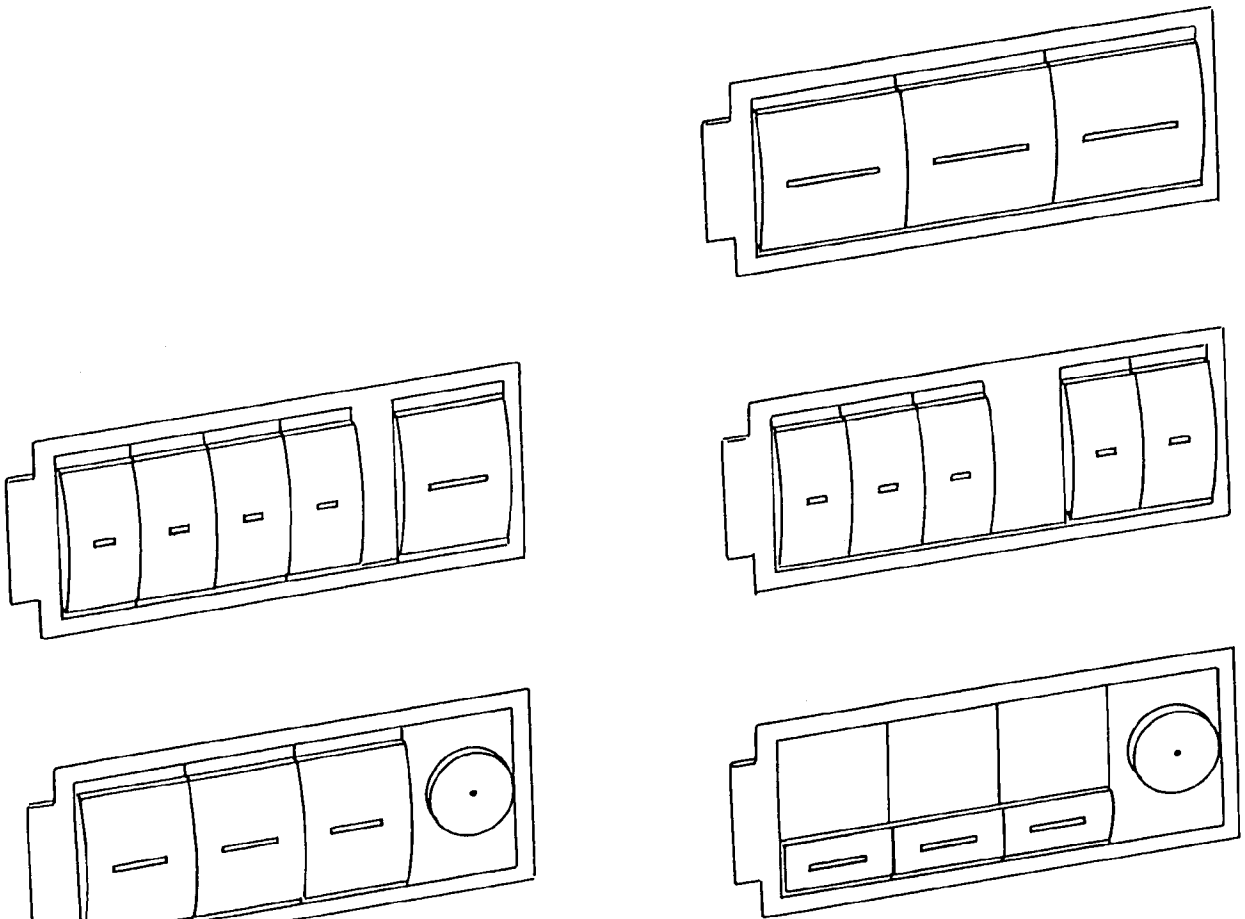
FIG. 7 shows different embodiments of key arrangements in line with the invention.

FIG. 7 also shows a few variants of the inventive key arrangement.

In the top-right variant, the key support 20 has just three particularly wide keys on it.

The variant below that corresponds to the arrangement comprising five keys in two groups from FIG. 1. To the left of that, the variant from FIGS. 3 and 4 is shown.

The bottom illustrations in FIG. 7 each show other forms of keys, for example with a circular projection or (on the right-hand side) keys which are preferably operated at their bottom end.

Generally, the key support 20 is designed to accommodate no more than six keys with a respective width of approximately 17 mm.

What is claimed is:

1. A key arrangement for a control panel on an electric appliance, the arrangement comprising:

at least one key with a front control face and at least one backward-protruding projection;

a key support which is in plate form and has at least one opening through which the projection is able to pass; and elastic means borne by the key support on the back side thereof, the elastic means operative to engage with the projection that passes through the opening and to prestress the key forwards front the key support.

2. The key arrangement according to claim 1, where the key support has a plurality of openings for bearing a plurality of keys.

3. The key arrangement according to claim 2, where the openings are at regular intervals.

4. The key arrangement according to claim 3, where the keys have different dimension, and where the dimensions of the keys and the position of the projections on the keys are coordinated with one another such that the positioning of the keys on the key support is variable.

5. The key arrangement according to claim 1, where the key support is made of a transparent material.

6. The key arrangement according to claim 1, where the front of the printed circuit board has at least one visual display arranged on it.

7. The key arrangement according to claim 6, wherein the visual display is an LED.

8. A panel arrangement for an electrical appliance, the panel arrangement having a control panel and a key arrangement, the key arrangement comprising:

at least one key with a front control face and at least one backward-protruding projection;

a key support which has at least one opening through which the projection is able to pass; and elastic means borne on the back of the key support, the elastic means operative to engage with the projection that passes through the opening and to prestress the key forwards from the key support, and the key support in the key arrangement being cohesively connected to the back of the control panel.

9. The panel arrangement according to claim 8, where a portion of the periphery of the key support is welded linearly to the back of the control panel.

10. The panel arrangement according to claim 9, where the periphery of the key support is welded linearly to the back of the control panel around the full circumference.

11. A key arrangement for a control panel on an electric appliance, the arrangement comprising:

at least one key having a front control face and at least one backward-protruding projection;

a key support having at least one opening through which the projection is able to pass towards the back of the key support; and elastic means disposed on the back of the key support, said elastic means being operative to engage with the projection that passes through the opening and to prestress the key forwards front the key support;

a printed circuit board disposed on the back of the key support; and at least one switch mounted on the printed circuit board, said switch being operated by said key.

12. The key arrangement according to claim 11, where the switch is arranged on the back of the printed circuit board, and where the projection on the key operates a lever which operates the switch.

13. The key arrangement according to claim 11, where the back of the key support has latching projections on it onto which the printed circuit board is latched.

14. The key arrangement according to claim 11, where the key support has a row of openings on it and where the printed circuit board is arranged substantially parallel to the plane of the key support and offset from the row of openings.

15. A key arrangement for a control panel on an electric appliance, the arrangement comprising:

at least one key with a front control face and at least one backward-protruding projection;

a key support having at least one opening through which the projection is able to pass; and elastic means disposed on the back of the key support, said elastic means having the form of a backward-protruding shroud, made of an elastic material, into which the projection engages and being operative to prestress the key forwards from the key support.

16. The key arrangement according to claim 15, where the shroud is closed.

17. The key arrangement according to claim 15, where the shroud is made of an elastic plastic, and where the key support is a plastic material more rigid than that of the shroud.

18. The key arrangement according to claim 17, where the key support and the shroud are cohesively connected to one another.

19. The key arrangement according to claim 18, where the key support and the elastic means are made using a two-component injection moulding method.

* * * * *